US009000316B2

(12) United States Patent
Maloney et al.

(10) Patent No.: US 9,000,316 B2
(45) Date of Patent: Apr. 7, 2015

(54) ELECTRICAL SWITCHING APPARATUS AND LINK ASSEMBLY THEREFOR

(71) Applicant: Eaton Corporation, Cleveland, OH (US)

(72) Inventors: James G. Maloney, Industry, PA (US); Jeffrey W. Lockhart, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 245 days.

(21) Appl. No.: 13/789,732

(22) Filed: Mar. 8, 2013

(65) Prior Publication Data

US 2014/0251773 A1 Sep. 11, 2014

(51) Int. Cl.

| | |
|---|---|
| ***H01H 23/00*** | (2006.01) |
| ***H01H 3/04*** | (2006.01) |
| ***H01H 23/16*** | (2006.01) |
| ***H01H 71/10*** | (2006.01) |
| *H01H 3/46* | (2006.01) |
| *H01H 3/48* | (2006.01) |

(52) U.S. Cl.

CPC ..... *H01H 3/04* (2013.01); *H01H 23/162* (2013.01); *H01H 3/46* (2013.01); *H01H 3/48* (2013.01); *H01H 71/10* (2013.01)

(58) Field of Classification Search

CPC ..... H01H 71/10; H01H 23/14; H01H 23/16; H01H 23/162

USPC ..... 200/400, 401

See application file for complete search history.

(56) References Cited

U.S. PATENT DOCUMENTS

| | | | | |
|---|---|---|---|---|
| 3,197,582 | A | 7/1965 | Norden | |
| 4,129,762 | A * | 12/1978 | Bruchet | 200/401 |
| 5,910,758 | A | 6/1999 | Maloney et al. | |
| 7,148,774 | B1 | 12/2006 | Shea et al. | |
| 7,217,895 | B1 | 5/2007 | Shea et al. | |
| 7,812,276 | B2 | 10/2010 | Maloney et al. | |
| 8,004,376 | B2 | 8/2011 | Maloney et al. | |
| 8,198,561 | B2 * | 6/2012 | Godesa | 200/400 |
| 2013/0220787 | A1 * | 8/2013 | Naiman et al. | 200/401 |

FOREIGN PATENT DOCUMENTS

EP 0 145 990 A2 6/1985

OTHER PUBLICATIONS

European Patent Office, "International Search Report and Written Opinion", May 21, 2014, 12 pp.

* cited by examiner

*Primary Examiner* — Renee S Luebke
*Assistant Examiner* — Lheiren Mae A Caroc
(74) *Attorney, Agent, or Firm* — Eckert Seamans Cherin & Mellot, LLC; Grant E. Coffield

(57) ABSTRACT

A link assembly is for an electrical switching apparatus, such as a circuit breaker. The circuit breaker includes a housing, separable contacts enclosed by the housing, and an operating mechanism for opening and closing the separable contacts. The operating mechanism includes a movable contact arm. The separable contacts comprise a stationary contact and a movable contact. The movable contact is disposed on the movable contact arm. The link assembly includes a pivot assembly pivotably coupled to the movable contact arm, a link element pivotably coupled to the pivot assembly, and a biasing element, such as a spring. A first end of the spring is coupled to the link element, and a second end of the spring is coupled to the circuit breaker housing.

18 Claims, 3 Drawing Sheets

ELECTRICAL SWITCHING APPARATUS AND LINK ASSEMBLY THEREFOR

BACKGROUND

1. Field

The disclosed concept relates generally to electrical switching apparatus and, more particularly, to electrical switching apparatus, such as circuit breakers. The disclosed concept also relates to link assemblies for electrical switching apparatus.

2. Background Information

Electrical switching apparatus, such as circuit breakers, provide protection for electrical systems from electrical fault conditions such as, for example, current overloads, short circuits, abnormal voltage and other fault conditions.

Typically, circuit breakers include an operating mechanism, which opens electrical contact assemblies to interrupt the flow of current through the conductors of an electrical system in response to such fault conditions. The electrical contact assemblies include stationary electrical contacts and corresponding movable electrical contacts that are typically mounted on movable (e.g., pivotable) arms. The stationary and movable contacts are in physical and electrical contact with one another when it is desired that the circuit breaker provide electrical current therethrough to a load. When it is desired to interrupt the power circuit, the movable contact arm is pivoted, thereby moving the movable contact away from the stationary contact creating a space therebetween. The opening distance (i.e., space) between the separable contacts can be undesirably limited by a number of factors, such as for example, size restrictions, and restrictions on the movement and mechanical interaction of assembly components.

There is, therefore, room for improvement in electrical switching apparatus, such as circuit breakers, and in link assemblies therefore.

SUMMARY

These needs and others are met by embodiments of the disclosed concept, which are directed to a link assembly for circuit breakers, which among other benefits, provides for increased break distance between separable contacts.

As one aspect of the disclosed concept a link assembly is provided for an electrical switching apparatus. The electrical switching apparatus includes a housing, separable contacts enclosed by the housing, and an operating mechanism for opening and closing the separable contacts. The operating mechanism includes a movable contact arm. The separable contacts comprise a stationary contact and a movable contact. The movable contact is disposed on the movable contact arm. The link assembly comprises: a pivot assembly structured to be pivotably coupled to the movable contact arm; a link element pivotably coupled to the pivot assembly; and a biasing element including a first end coupled to the link element and a second end structured to be coupled to the housing of the electrical switching apparatus.

The pivot assembly may comprise at least one pivot member having a first portion, a second portion, and a third portion disposed between the first portion and the second portion. The first portion may be structured to engage and cooperate with the housing, the second portion may be coupled to the link element, and the third portion may be structured to be pivotably coupled to the movable contact arm. The second portion may include a first movement element, wherein the link element comprises a number of second movement elements, and wherein the first movement element of the second portion cooperates with a corresponding one of the second movement elements of the link element. The first movement element may be an elongated slot, and the number second movement elements may be a number of protrusions, wherein a corresponding one of the protrusions is movably disposed in the elongated slot.

The link element may further comprise a first segment and a second segment disposed opposite and distal from the first segment. The number of protrusions may extend outwardly from the first segment, and the biasing element may be coupled to the second segment. The movable contact arm may further comprise a first side and a second side, and the at least one pivot member may be a first pivot member and a second pivot member. The first pivot member may be structured to be pivotably coupled to the first side of the movable contact arm, and the second pivot member may be structured to be pivotably coupled to the second side of the movable contact arm.

The first segment of the link element may include a first extension and a second extension disposed opposite and spaced from the first extension, wherein number of protrusions is a first protrusion extending inwardly from the first extension and a second protrusion extending inwardly from the second extension. The first protrusion may be movably disposed within the elongated slot of the first pivot member, and the second protrusion may be movably disposed within the elongated slot of the second pivot member.

An electrical switching apparatus employing the aforementioned link assembly is also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
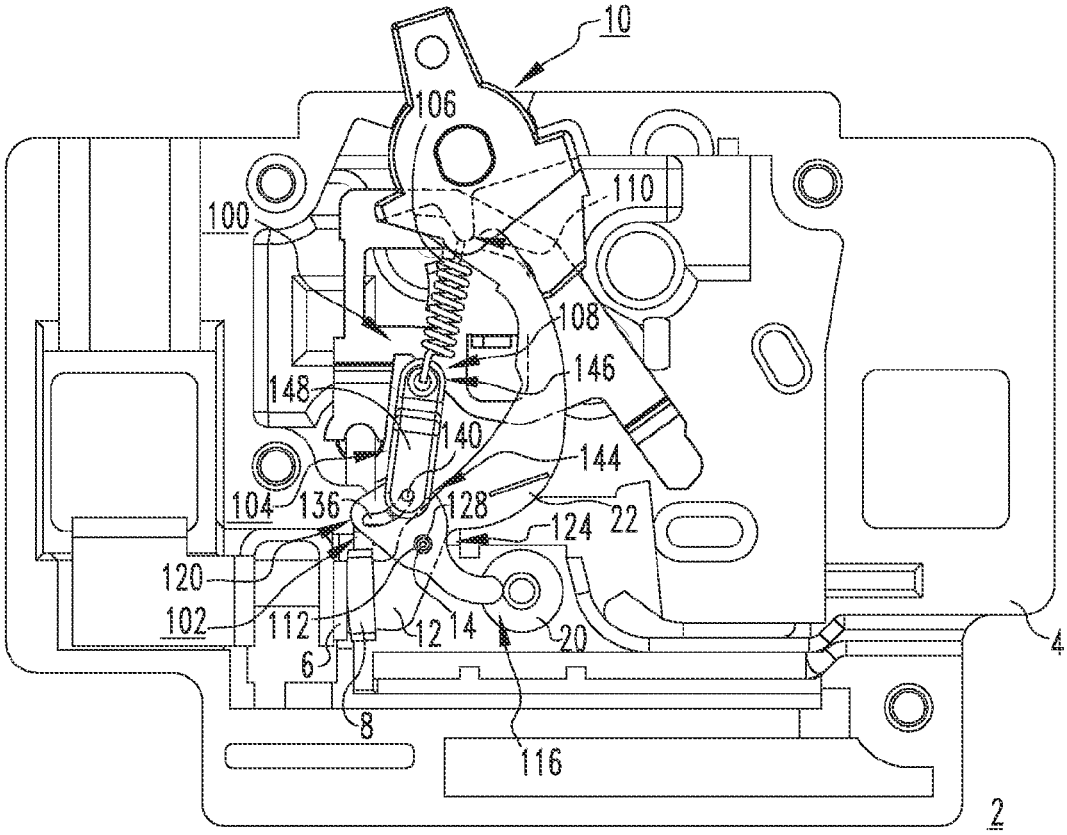
FIG. 1 is a side elevation view of a circuit breaker and link assembly therefore, in accordance with an embodiment of the disclosed concept, showing the circuit breaker in the ON position.

Directional phrases used herein, such as, for example, clockwise, counterclockwise, left, right and derivatives thereof, relate to the orientation of the elements shown in the drawings and are not limiting upon the claims unless expressly recited therein.

As employed herein, the terms "opening distance" and "break distance" are used substantially interchangeably to refer to the maximum available distance or space between separable contacts (i.e., a stationary contact and the corresponding movable contact).

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
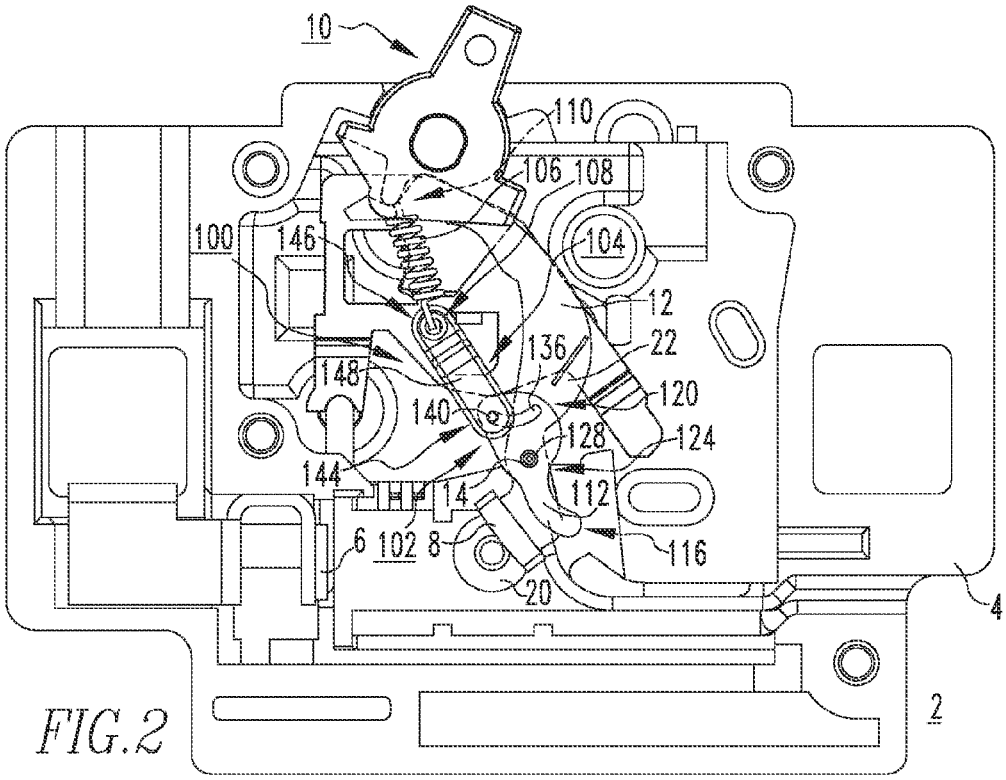
FIG. 2 is a side elevation view of the circuit breaker and link assembly therefore of FIG. 1, showing the circuit breaker in the OFF position.
Figure 3:
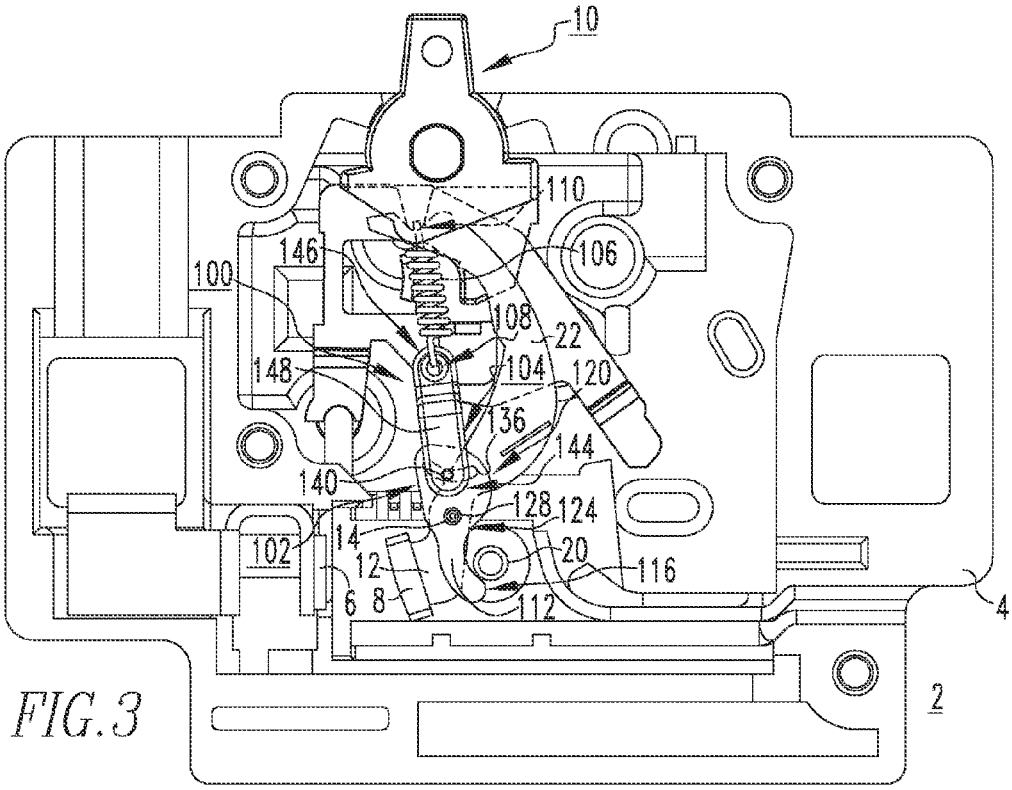
FIG. 3 is a side elevation view of the circuit breaker and link assembly therefore of FIG. 2, showing the circuit breaker in the TRIPPED position.

FIG. 1 shows a link assembly 100 (best shown in the exploded isometric view of FIG. 4) for an electrical switching apparatus, such as for example and without limitation, the circuit breaker 2, shown. The circuit breaker 2 includes a housing 4, separable contacts 6,8 enclosed by the housing 4, and an operating mechanism 10 for opening and closing the separable contacts 6,8. The operating mechanism 10 includes a movable contact arm 12. The separable contacts 6,8, include a stationary contact 6 and a movable contact 8, which is disposed on the end of the movable contact arm 12, as shown. Thus, it will be appreciated that the movable contact arm 12 is movable (e.g., without limitation, pivotable) to move the movable contact 8 away from the stationary contact 6, in order to electrically disconnect the contacts 6,8 to turn the circuit breaker OFF, as shown in FIG. 2, or when the circuit breaker 2 trips in response to an electrical fault condition, as shown in FIG. 3.

The opening distance or break distance between separable contacts (not shown) of conventional circuit breakers (not shown) is limited by a number of factors, such as for example and without limitation, size restrictions, and restrictions on the movement and mechanical interaction of assembly components. As will be described in greater detail herein, the disclosed link assembly 100 is designed to address and overcome these disadvantages by enabling an increase in the break distance.

Continuing to refer to FIGS. 1-3, and also to FIG. 4, the example link assembly 100 will now be described in greater detail. In the example shown and described herein, the link assembly 100 includes a pivot assembly 102, a link element 104, and a biasing element 106 having opposing first and second ends 108,110. The pivot assembly 102 is pivotably coupled to the movable contact arm 12. The link element 104 is pivotably coupled to the pivot assembly 102. In the example shown and described herein, the biasing element is a spring 106. The first end 108 of the spring 106 is coupled to the link element 104, and the second end 110 of the spring 106 is coupled to the circuit breaker housing 4.

Figure 4:
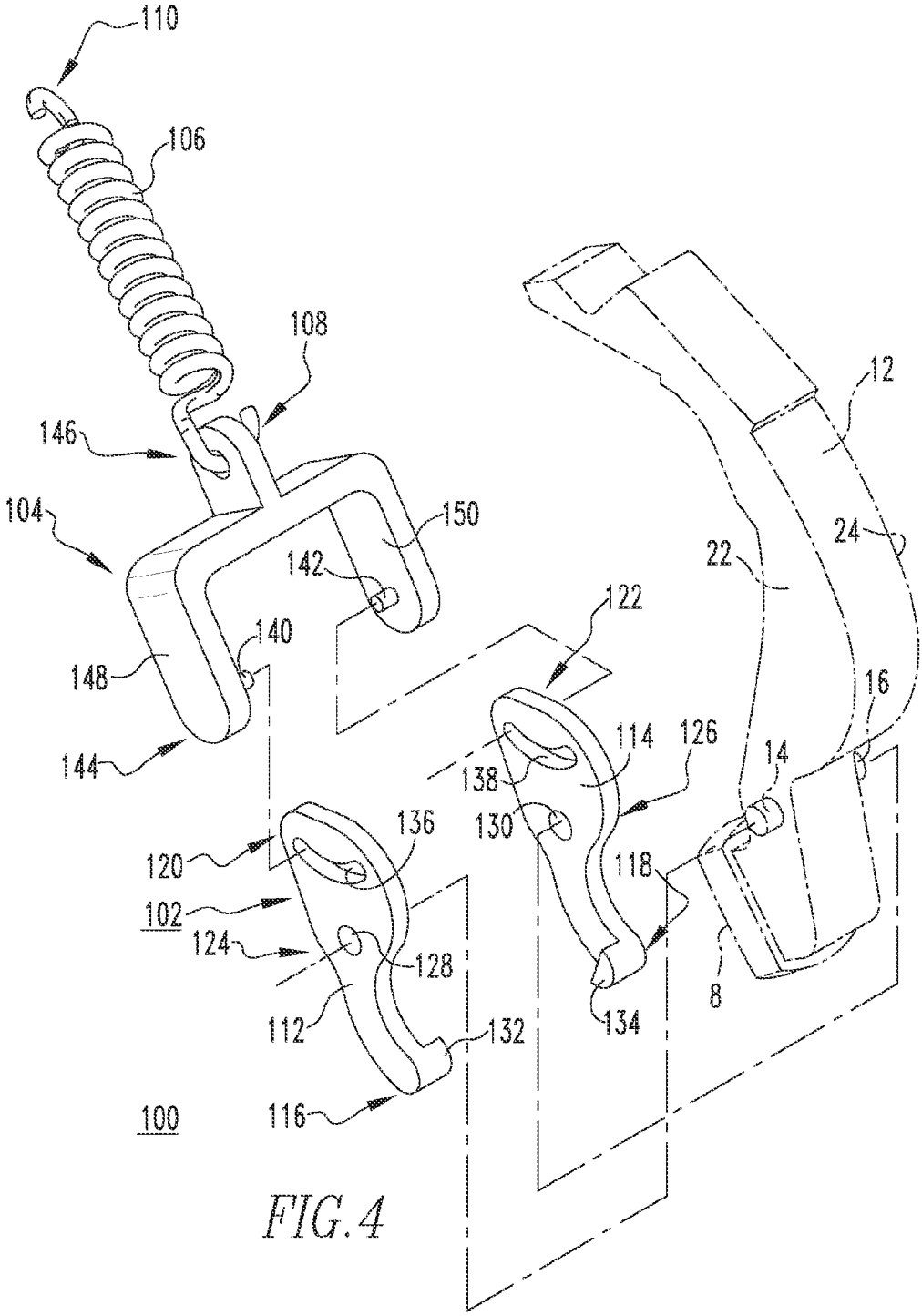
FIG. 4 is an exploded isometric view of the link assembly of FIG. 3.

As best shown in FIG. 4, the pivot assembly 102 preferably includes first and second pivot members 112,114 each having a first portion 116,118, a second portion 120,122, and a third portion 124,126, respectively. The first portions 116,118 cooperate with the circuit breaker housing 4 (FIGS. 1-3), the second portions 120,122 are coupled to the link element 104, and the third portions 124,126 are pivotably coupled to the movable contact arm 12. It will be appreciated that, while the pivot assembly 102 shown and described herein includes two pivot members 112,114, any known or suitable alternative number and/or configuration (not shown) of different pivot members (not shown) could be employed, without departing from the scope of the disclosed concept.

The third portions 124,126 include first pivot elements 128,130, and the movable contact arm 12 includes second pivot elements 14,16, which cooperate with the first pivot elements 128,130, respectively, to pivotably couple the pivot members 112,114 to the movable contact arm 12. In the non-limiting example shown herein, the first pivot elements 128,130 of the first and second pivot members 112,114 are holes 128,130 (best shown in FIG. 4). The second pivot elements 14,16 of the movable contact arm 12 are first and second projections 14,16 extending outwardly from the opposing first and second sides 22,24, respectively, of the movable contact arm 12. Thus, the first projection 14 is pivotably disposed within the first hole 128, and the second projection 16 is pivotably disposed within the second hole 130, thereby enabling the first and second pivot members 112,114 to pivot with respect to the movable contact arm 12. It will be appreciated, however, that any known or suitable alternative type, number and/or configuration (not shown) of different pivot elements (not shown) could be employed on the pivot members 112,114 and/or movable contact arm 12. For example and without limitation, the pivot members 112, 114 could include projections (not shown), which cooperate with corresponding holes or recesses (not shown) on the movable contact arm 12. Yet another non-limiting alternative would be to employ a pin member (not shown) extending through holes 128 and 130 of pivot members 112 and 114, respectively, as well as a corresponding hole (not shown) extending through the movable contact arm 12.

Similarly, it will be appreciated that the link element 104 could have any known or suitable alternative configuration other than the non-limiting embodiment shown and described herein. The example link element 104 includes a first segment 144 and a second segment 146 disposed opposite and distal from the first segment 144. The second portions 120,122 of the first and second pivot members 112,114 include first movement elements 136,138, and the first segment 144 of the link element 104 includes a number of second movement elements 140,142. The first movement elements 136,138 cooperate with the corresponding second movement elements 140,142 (all shown in FIG. 4). In the example shown, the first movement elements are first and second elongated slots 136,138 disposed in the first and second pivot members 112,114 (best shown in FIG. 4), and the second movement elements are a pair of opposing protrusions 140,142 each structured to be movably disposed in the corresponding one of the elongated slots 136,138.

The first segment 144 of the example link element 104 further includes a first extension 148 and a second extension 150 disposed opposite and spaced from the first extension 148. The aforementioned first protrusion 140 extends inwardly from the first extension 148, and the aforementioned second protrusion 142 extends inwardly from the second extension 150. Thus, the first protrusion 140 is movably disposed within the elongated slot 136 of the first pivot member 112, and the second protrusion 142 is movably disposed within the elongated slot 138 of the second pivot member 114, as shown (in exploded form) in FIG. 4. The aforementioned spring 106 is coupled to the second segment 146 of the link element 104, as shown. It will be appreciated, however, that the link element 104 could have any known or suitable alternative configuration (not shown) and/or movement elements (not shown) other than the non-limiting embodiment shown and described herein, without departing from the scope of the disclosed concept. Likewise, the pivot members 112,114 could have any known or suitable alternative number, type and/or configuration of corresponding movement elements (not shown) other than the elongated slots 136,138 shown and described herein.

In view of the foregoing, it will be appreciated that the disclosed link assembly 100 provides a multiple component design structured to facilitate movement of the movable contact arm 12, and ultimately increase separation of (i.e., distant between) the movable contact 8 from the separable contact 6 (both shown in FIGS. 1-3). In other words, the link assembly 100 advantageously increases the break distance between the separable contacts 6,8.

Specifically, in operation, when the movable contact arm 12 pivots or rotates from the ON position of FIG. 1 to the OFF position of FIG. 2, the first portions 116,118 (both shown in FIG. 4) of the pivot members 112,114 (both shown in FIG. 4), respectively, engage a portion (see, for example and without limitation, molded protrusion 20) of the circuit breaker housing 4, as shown in FIG. 1. As shown in the example of FIG. 4, the first and second pivot members 112,114 include first and second lateral projections 132,134 extending inwardly from the first portions 116,118, respectively, thereof. Such lateral projections 132,134 function as a "kicker" that, upon engagement with the molded protrusion 20 of the circuit breaker housing 4, forces the pivot members 112,114 to pivot (e.g., clockwise from the perspective of FIGS. 1-3), thereby moving the protrusions 140,142 of link element 104 within the corresponding elongated slots 136,138 of the pivot members 112,114, respectively. That is, the protrusions 140,142 move toward the center position of the elongated slots 136,138 (see FIG. 3). Then, as the movable contact arm 12 continues to rotate or pivot (e.g., clockwise from the perspective of FIGS. 1-3), the protrusions 140,142 move further to the extreme end (e.g., left end from the perspective of FIG. 2) of the corresponding elongated slots 136,138, respectively. Accordingly, when the protrusions 140,142 (e.g., without limitation, pins) are disposed in the left most extreme position, as shown in FIG. 2, the final resting position of the movable contact arm 12 is such that the breaker distance, or distance between the stationary contact 6 and movable contact 8, is greater than it would otherwise be. That is, the breaker distance is exaggerated or increased. Such increase in breaker distance will be further appreciated with comparison of the OFF position of FIG. 2 to the TRIPPED position of FIG. 3.

Accordingly, among other benefits, the disclosed link assembly 100 provides for greater break distance between the separable contacts 6,8 of the circuit breaker 2. This, in turn, advantageously increases the voltage the circuit breaker 2 can withstand before it dioelectrically breaks down.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A link assembly for an electrical switching apparatus, said electrical switching apparatus including a housing, separable contacts enclosed by the housing, and an operating mechanism for opening and closing said separable contacts, said operating mechanism including a movable contact arm, said separable contacts comprising a stationary contact and a movable contact, the movable contact being disposed on said movable contact arm, said link assembly comprising:

a pivot assembly structured to be pivotably coupled to said movable contact arm;

a link element pivotably coupled to said pivot assembly; and a biasing element including a first end coupled to said link element and a second end structured to be coupled to the housing of said electrical switching apparatus;

wherein said pivot assembly comprises at least one pivot member having a first portion, a second portion, and a third portion disposed between the first portion and the second portion; wherein the first portion is structured to engage and cooperate with the housing; wherein the second portion is coupled to said link element; and wherein the third portion is structured to be pivotably coupled to said movable contact arm.

2. The link assembly of claim 1 wherein the third portion includes a first pivot element; wherein said movable contact arm includes a second pivot element; and wherein said first pivot element of the third portion is structured to cooperate with said second pivot element of said movable contact arm.

3. The link assembly of claim 1 wherein the first portion includes a lateral projection; and wherein said lateral projection is structured to engage and cooperate with a portion of the electrical switching apparatus housing, thereby pivoting said at least one pivot member with respect to said movable contact arm.

4. The link assembly of claim 1 wherein the second portion includes a first movement element; wherein said link element comprises a number of second movement elements; and wherein said first movement element of the second portion cooperates with a corresponding one of said second movement elements of said link element.

5. The link assembly of claim 4 wherein said first movement element is an elongated slot; wherein said number second movement elements is a number of protrusions; and wherein a corresponding one of said protrusions is movably disposed in said elongated slot.

6. The link assembly of claim 5 wherein said link element further comprises a first segment and a second segment disposed opposite and distal from the first segment; wherein said number of protrusions extend outwardly from the first segment; and wherein said biasing element is coupled to the second segment.

7. The link assembly of claim 6 wherein said biasing element is a spring; wherein the first end of said spring is coupled to the second segment; and wherein second end is structured to be coupled to the housing.

8. The link assembly of claim 6 wherein said movable contact arm further comprises a first side and a second side; wherein said at least one pivot member is a first pivot member and a second pivot member; wherein the first pivot member is structured to be pivotably coupled to the first side of said movable contact arm; and wherein the second pivot member is structured to be pivotably coupled to the second side of said movable contact arm.

9. The link assembly of claim 8 wherein the first segment of said link element includes a first extension and a second extension disposed opposite and spaced from the first extension; wherein number of protrusions is a first protrusion extending inwardly from the first extension and a second protrusion extending inwardly from the second extension; wherein said first protrusion is movably disposed within said elongated slot of said first pivot member; and wherein said second protrusion is movably disposed within said elongated slot of said second pivot member.

10. An electrical switching apparatus comprising:

a housing;

separable contacts enclosed by the housing;

an operating mechanism for opening and closing said separable contacts, said operating mechanism including a movable contact arm, said separable contacts comprising a stationary contact and a movable contact, the movable contact being disposed on said movable contact arm; and a link assembly comprising:

a pivot assembly pivotably coupled to said movable contact arm, a link element pivotably coupled to said pivot assembly, and a biasing element including a first end coupled to said link element and a second end coupled to the housing:

wherein said pivot assembly comprises at least one pivot member having a first portion, a second portion, and a third portion disposed between the first portion and the second portion; wherein the first portion cooperates with the housing; wherein the second portion is coupled to said link element; and wherein the third portion is pivotably coupled to said movable contact arm.

11. The electrical switching apparatus of claim 10 wherein the third portion includes a first pivot element; wherein said movable contact arm includes a second pivot element; and wherein said first pivot element of the third portion cooperates with said second pivot element of said movable contact arm.

12. The electrical switching apparatus of claim 10 wherein the first portion includes a lateral projection; and wherein said lateral projection is structured to engage and cooperate with a portion of the electrical switching apparatus housing, thereby pivoting said at least one pivot member with respect to said movable contact arm.

13. The electrical switching apparatus of claim 10 wherein the second portion includes a first movement element; wherein said link element comprises a number of second movement elements; and wherein said first movement element of the second portion cooperates with a corresponding one of said second movement elements of said link element.

14. The electrical switching apparatus of claim 13 wherein said first movement element is an elongated slot; wherein said number second movement elements is a number of protrusions; and wherein a corresponding one of said protrusions is movably disposed in said elongated slot.

15. The electrical switching apparatus of claim 14 wherein said link element further comprises a first segment and a second segment disposed opposite and distal from the first segment; wherein said number of protrusions extend outwardly from the first segment; and wherein said biasing element is coupled to the second segment.

16. The electrical switching apparatus of claim 15 wherein said biasing element is a spring; wherein the first end of said spring is coupled to the second segment; and wherein second end is coupled to the housing.

17. The electrical switching apparatus of claim 15 wherein said movable contact arm further comprises a first side and a second side; wherein said at least one pivot member is a first pivot member and a second pivot member; wherein the first pivot member is pivotably coupled to the first side of said movable contact arm; and wherein the second pivot member is pivotably coupled to the second side of said movable contact arm.

18. The electrical switching apparatus of claim 17 wherein the first segment of said link element includes a first extension and a second extension disposed opposite and spaced from the first extension; wherein number of protrusions is a first protrusion extending inwardly from the first extension and a second protrusion extending inwardly from the second extension; wherein said first protrusion is movably disposed within said elongated slot of said first pivot member; and wherein said second protrusion is movably disposed within said elongated slot of said second pivot member.

* * * * *